US009873063B2

(12) United States Patent
Parsley

(10) Patent No.: US 9,873,063 B2
(45) Date of Patent: Jan. 23, 2018

(54) THROW TOY

(71) Applicant: Orbit Toys, LLC, Reseda, CA (US)

(72) Inventor: Adam Kane Parsley, Reseda, CA (US)

(73) Assignee: Orbit Toys, LLC, Reseda, CA (US)

( * ) Notice: Subject to any disclaimer, the term of this patent is extended or adjusted under 35 U.S.C. 154(b) by 0 days.

(21) Appl. No.: 15/340,479

(22) Filed: Nov. 1, 2016

(65) Prior Publication Data

US 2017/0120160 A1 May 4, 2017

Related U.S. Application Data

(60) Provisional application No. 62/249,748, filed on Nov. 2, 2015.

(51) Int. Cl.
*A63H 33/18* (2006.01)
*A63B 65/10* (2006.01)

(52) U.S. Cl.
CPC ..... *A63H 33/18* (2013.01)

(58) Field of Classification Search
CPC ..... A63B 65/10; A63F 9/02; A63H 33/18
See application file for complete search history.

(56) References Cited

U.S. PATENT DOCUMENTS 4,737,128 A * 4/1988 Moormann ..... A63B 65/10 446/46
D327,921 S 7/1992 Sobel
D337,623 S 7/1993 Franker
5,382,027 A * 1/1995 Eatherly ..... A63B 67/086 273/317
5,676,581 A * 10/1997 Ziegler ..... A63H 33/18 446/240
D398,939 S 9/1998 Harned
D418,880 S 1/2000 Albarelli, Jr.
D433,719 S 11/2000 Hutchings
D434,457 S 11/2000 Goldman et al.
6,174,214 B1 * 1/2001 Cooper ..... A63H 33/18 446/46
D464,088 S 10/2002 Hu
D480,766 S 10/2003 Moon
D547,813 S 7/2007 Chernick et al.
D559,919 S 1/2008 Wedding, II
2001/0024923 A1 9/2001 Streit
2003/0092515 A1 5/2003 Darnell
2011/0009026 A1 1/2011 Feng

OTHER PUBLICATIONS

International Search Report for the International Application No. PCT/US2017/22891 dated May 1, 2017.

* cited by examiner

*Primary Examiner* — John Ricci
(74) *Attorney, Agent, or Firm* — Kelly & Kelley, LLP

(57) ABSTRACT

A throw toy includes a generally disc-shaped elastomeric base having a central hub and a skirt encircling and extending outwardly from the central hub. A plurality of projecting fingers extend away from a first surface of the base for stabilizing the throw toy in flight. The base may be biased to a semi-spherical shape when stationary, and may be folded into a ball prior to being thrown, but flattens in flight.

39 Claims, 14 Drawing Sheets

THROW TOY

RELATED APPLICATIONS

This application claims priority to U.S. Provisional Application Ser. No. 62/249,748, filed Nov. 2, 2015.

BACKGROUND OF THE INVENTION

The present invention generally relates to toys that are thrown through the air. More specifically, the present invention is directed to a toy that may be wound up into a ball, but once it is thrown it spreads out like a wing and flies flat through the air.

Toys such as Frisbees, flying loops, Nerf® footballs, and similar throwing toys have been known for many years. Children and adults alike have found great enjoyment in using toys of this nature for a game of catch at times of recreation. While such toys can provide entertainment, some people might find it hard to throw a Frisbee, to put a spiral on a Nerf® football. While a regular spherical ball is relatively easy to throw back and forth, this can become monotonous over time. Furthermore, some people might find the hard plastic of a Frisbee, flying loop, or other throwing toy painful to catch.

Because a game of catch has long been a common pastime, it would be welcomed to provide new toys that fly through the air and allow a game of catch to ensue. More particularly, a throwing toy that could easily be thrown like a spherical ball, flies through the air similar to a Frisbee, and that is also soft and easy to catch would be well received.

Accordingly, there is a need for a throwing toy that is easy and entertaining to throw, and also soft and easy to catch. The present invention fulfills these needs and provides other related advantages. The present invention fulfills these needs and provides other related advantages.

SUMMARY OF THE INVENTION

The present invention resides in a toy which is thrown through the air. The throw toy is easy and entertaining to throw, and also soft and easy to catch. The throw toy can be easily folded or compressed into a ball prior to being thrown, and once thrown assumes a generally planar configuration so as to fly through the air similar to a Frisbee.

The throw toy comprises a generally disc-shaped elastomeric base having first and second surfaces. The base may be comprised of a silicone or rubber material. The base includes a central hub and a skirt encircling and extending outwardly from the central hub. A plurality of projecting fingers extend away from the first surface of the base for stabilizing the throw toy in flight. The second surface of the base is smooth and devoid of projecting fingers. The projecting fingers are configured and arranged to cause lift to the throw toy by air passing through and/or over the projecting fingers.

The second surface of the base forms a concave semi-spherical surface when the throw toy is stationary. Although the base is biased to a semi-spherical shape when stationary, it flattens in flight.

The skirt is comprised of multiple segments extending from the central hub and disposed adjacent to one another. Typically, the multiple segments have generally identical geometric configurations. A hinge is formed in the base between adjacent edges of the segments. The hinges are of a reduced thickness compared to the segments. The hinges typically extend from the central hub between adjacent edges of the segments to a peripheral edge of the skirt.

Each segment may include a plurality of projecting fingers extending from the first surface thereof. Each segment typically includes an equal number of projecting fingers. The projecting fingers of a segment may be substantially equally spaced apart from adjacent projecting fingers.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
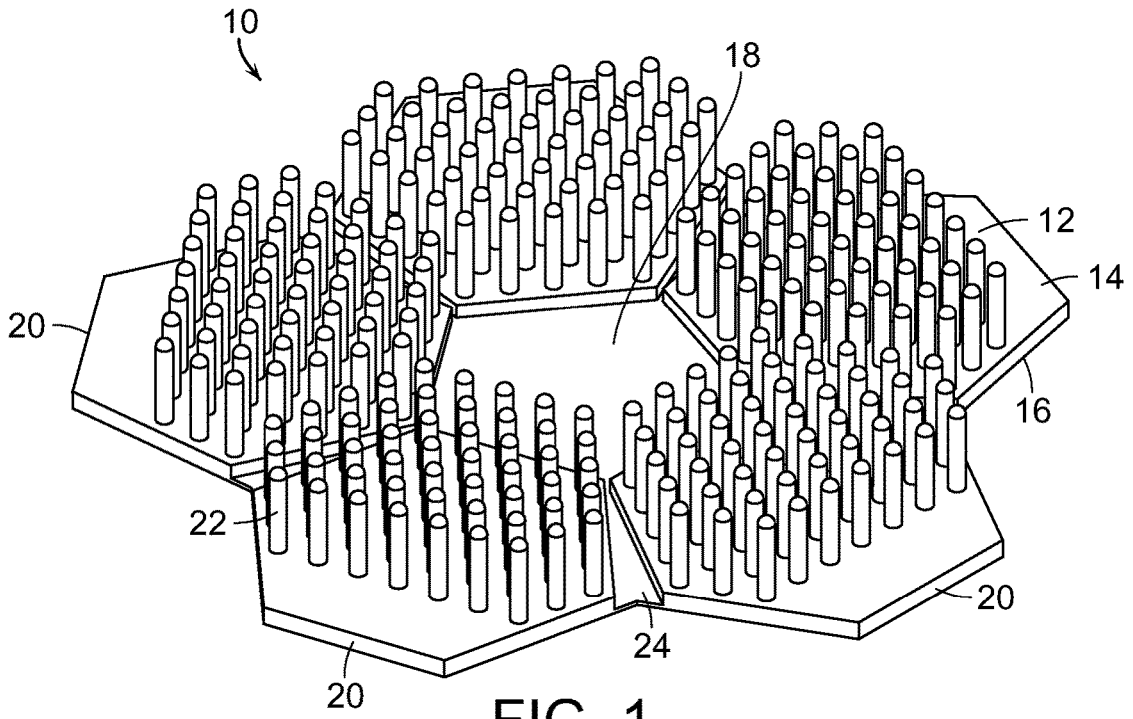
FIG. 1 is a top perspective view of the throw toy embodying the present invention.

As shown in the drawings and for purposes of illustration, the present invention is directed to a throw toy generally referred to by the reference number 10. Generally, the throw toy 10 is comprised of a soft and pliable material, typically an elastomeric material such as silicone or rubber or the like which can be folded, wound up, or otherwise compressed like a ball, but once it is thrown, it spreads out like a wing and flies flat through the air. Due to the soft nature of the material used to construct the throw toy 10, it is easily caught without any pain, and is less likely to cause harm to any surrounding objects which are inadvertently hit by the flying throw toy 10.

Figure 2:
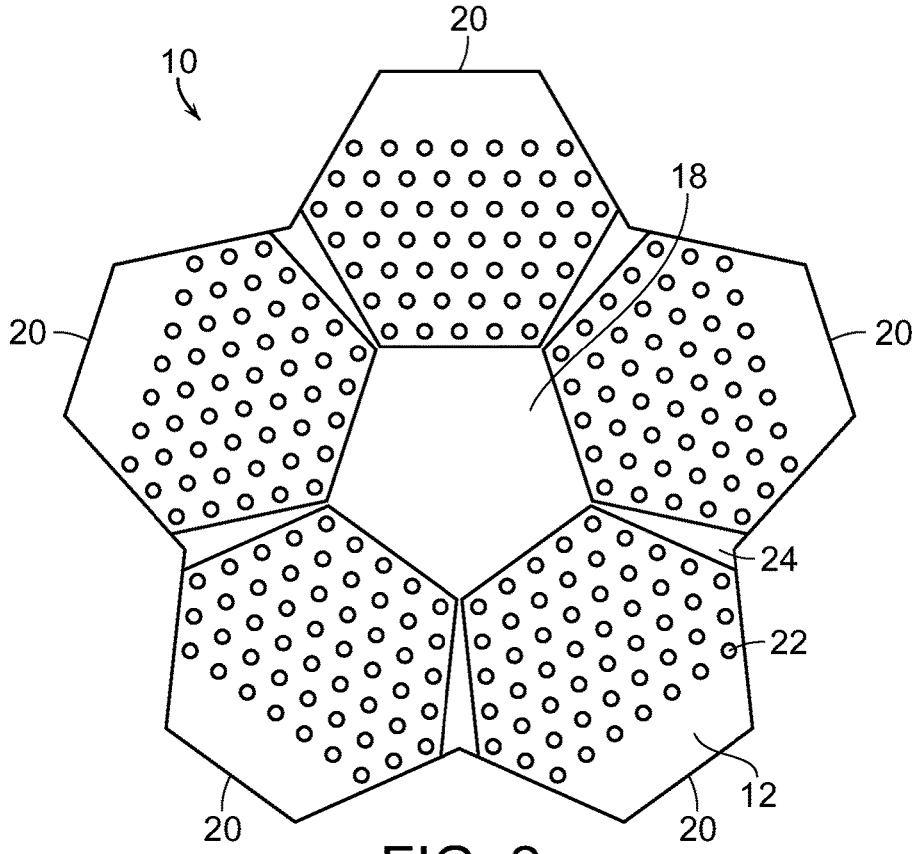
FIG. 2 is a top plan view of the throw toy of FIG. 1.

With reference to FIGS. 1 and 2, an embodiment of the throw toy 10 is illustrated. The throw toy 10 is comprised of a generally disc-shaped elastomeric base 12 having an upper first surface 14 and a lower second surface 16. The base 12 includes a central hub 18. Multiple segments 20 extend from the central hub 18 and are disposed adjacent to one another, forming a skirt encircling and extending outwardly from the central hub 18. A plurality of projecting fingers 22 extend away from the first surface 14 of the base 12 for stabilizing the throw toy 10 in flight. Typically, the base 12, including the central hub 18, segments 20 defining the skirt, and the projecting fingers 22 are all comprised of a soft and pliable elastomeric material, such as silicone, rubber or the like.

The projecting fingers 22 extend only from the upper first surface 14 of the base 12. The second lower surface 16 of the base 12 is devoid of the projecting fingers. As mentioned above, the projecting fingers stabilize the throw toy in flight. The projecting fingers 22 are configured and arranged to cause lift to the throw toy by air passing through and/or over the projecting fingers 22.

Typically, as illustrated in FIGS. 1 and 2, each segment 20 has a plurality of fingers 22 projecting upwardly therefrom. Each segment 20 may include approximately an equal number of projecting fingers 22. The projecting fingers 22 of each segment 2 may be substantially equally spaced apart from adjacent projecting fingers 22. Typically, the fingers 22 project upwardly a fraction of an inch. They are sufficient in number and configuration so as to create lift to the throw toy 10 when it is thrown through the air. Depending upon the diameter or size of the projecting fingers 22, there may be several dozen fingers 22 projecting upwardly from the first surface 14 of each segment 20. In the embodiments illustrated herein, there are several dozen, and at least forty, fingers 22 projecting upwardly from each segment 20.

The flight of the throw toy 10 is stabilized, as previously mentioned, by the projecting fingers 22. While in flight, the projecting fingers 22 effectively increase the velocity of the air passing over the top of the throw toy 10. The air moves at a greater velocity as it flows through the projecting fingers 22 because the area in which the air is allowed to flow is decreased by the projecting fingers 22. The increase in the velocity of the air as it passes through the projecting fingers 22 is modeled by the equation of continuity:

$$A_1 v_1 = A_2 v_2$$

'$A_1$' is the area in which the air flows before it enters the projecting fingers 22.

'$v_1$' is the velocity of the air before entering the projecting fingers 22.

'$A_2$' is the area in which the air flows while in the projecting fingers 22.

'$v_2$' is the velocity of the air while in the projecting fingers 22.

Since the area in which the air can flow is smaller while in the projecting fingers 22, the air passing above the throw toy 10 moves at a greater velocity than it was before entering the projecting fingers 22. Consequently, the air above the throw toy 10 moves with a greater velocity than the air below the throw toy 10 as the toy 10 flies. It then follows that the pressure under the throw toy 10 is greater than the pressure above the throw toy 10 in accordance with Bernoulli's Equation:

$$P_1 + 0.5 * \rho v_1^2 = P_2 + 0.5 * \rho v_2^2$$

'$P_1$' is the pressure above the throw toy 10.

'$\rho$' is the density of the air.

'$v_1$' is the velocity of the air above the throw toy 10.

'$P_2$' is the pressure bellow the throw toy 10.

'$v_2$' is the velocity of the air bellow the throw toy 10.

This difference in pressure above and below the throw toy 10 allows the throw toy 10 to be stabilized in flight and to have a lift force acting on the throw toy 10. The lift force helps the throw toy 10 to travel a greater distance in the air when it is thrown.

Figure 4:
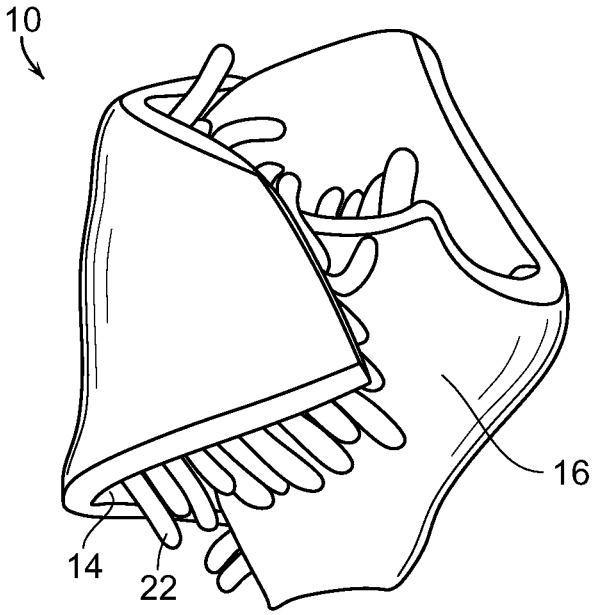
FIG. 4 is a perspective view of the throw toy illustrating that the throw toy may be folded or compressed into a ball.
Figure 5:
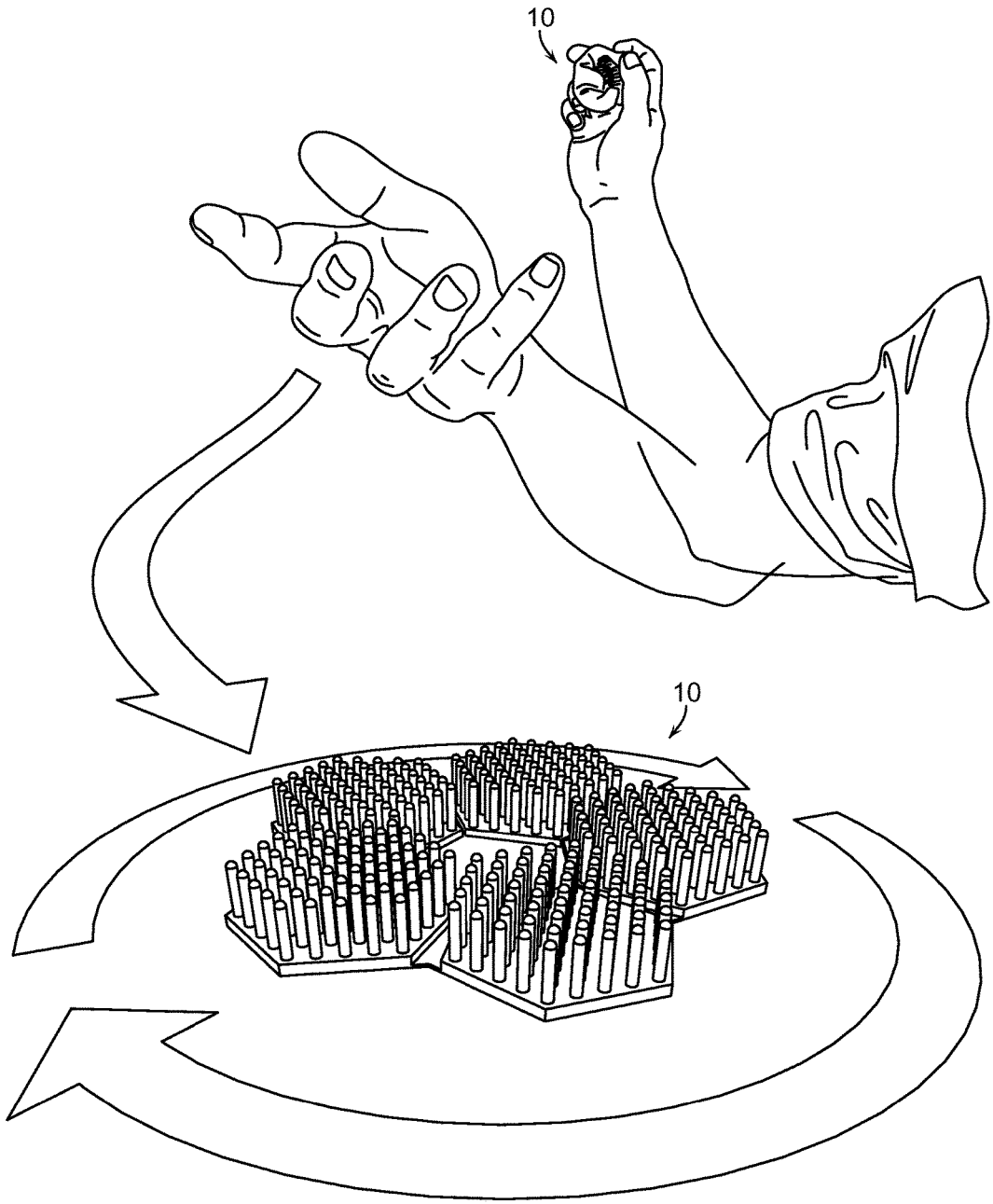
FIG. 5 is an environmental and perspective view of the throw toy being thrown.

With reference now to FIGS. 4 and 5, due to the nature of the elastomeric material from which the throw toy 10 is comprised, it can be folded, including wound up, or otherwise compressed, and formed into a general ball shape, as illustrated in FIG. 4. This enables the user to hold the compressed and folded throw toy 10 in his or her hand and throw it through the air, as illustrated in FIG. 5. Due to the design and configuration of the throw toy 10, as the base 12 is sufficiently flexible so as to be folded into the ball prior to being thrown, once it is thrown it assumes a generally planar configuration, as illustrated in FIG. 5, as the forces acting thereon tend to flatten and extend outwardly the segments 20 forming the skirt of the throw toy 10. As mentioned above, the fingers 22 projecting upwardly from the first surface 14 create stabilization for the throw toy 10 in flight, and create lift as the air passes through and/or over the projecting fingers 22.

Thus, once the throw toy 10 is released, it opens up generally flat and flies through the air similar to a Frisbee.

With reference again to FIGS. 1 and 2, in a particularly preferred embodiment the multiple segments 20 have generally identical geometric configurations, such as the illustrated hexagons in the embodiment of FIGS. 1 and 2. Moreover, the central hub 18 will have a geometric configuration which can be circular or multi-faceted. An area of reduced cross-sectional thickness forming a hinge 24 is formed in the base 12 between adjacent edges of the segments 20. The hinges 24 typically extend from the central hub 18 between adjacent edges of the segments 20 to a peripheral edge of the skirt, as shown.

Figure 8:
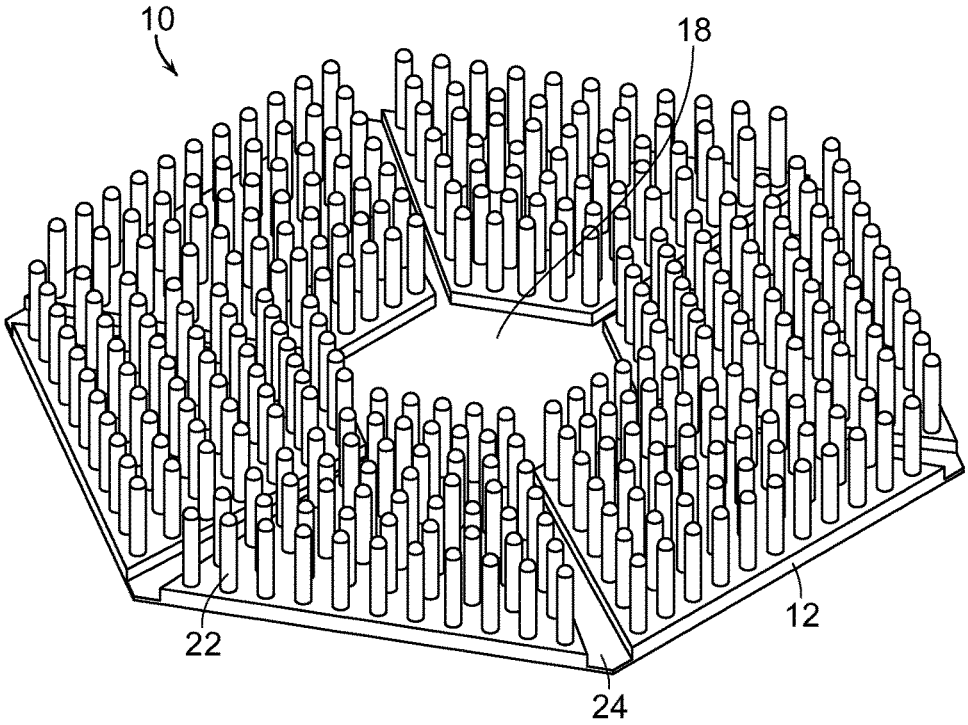
FIG. 8 is a top perspective view of an alternate embodiment of the throw toy in the shape of a hexagon.

The hinges 24 enable the throw toy 10 to be more easily folded and wound up like as a ball, as illustrated in FIG. 8. Moreover, the hinges 24 enable the individual segments 20 to somewhat independently move relative to one another while the throw toy 10 is in flight, allowing the throw toy 10 to self-stabilize as various segments 20 move upwardly and/or downwardly while flying through the air during use.

The central hub 18 and the segments 20 defining the skirt may be of a generally same thickness or of varying thicknesses. For example, the central hub 18 may comprise an aperture or opening in the center of the throw toy 10, be of reduced cross-sectional thickness as compared to the segments 20 or of a greater thickness than the segments 20. Typically, the central hub 18 does not have fingers 22 projecting upwardly therefrom, but as illustrated in FIG. 3, the central hub 18 can have fingers 22 projecting upwardly therefrom.

Figure 3:
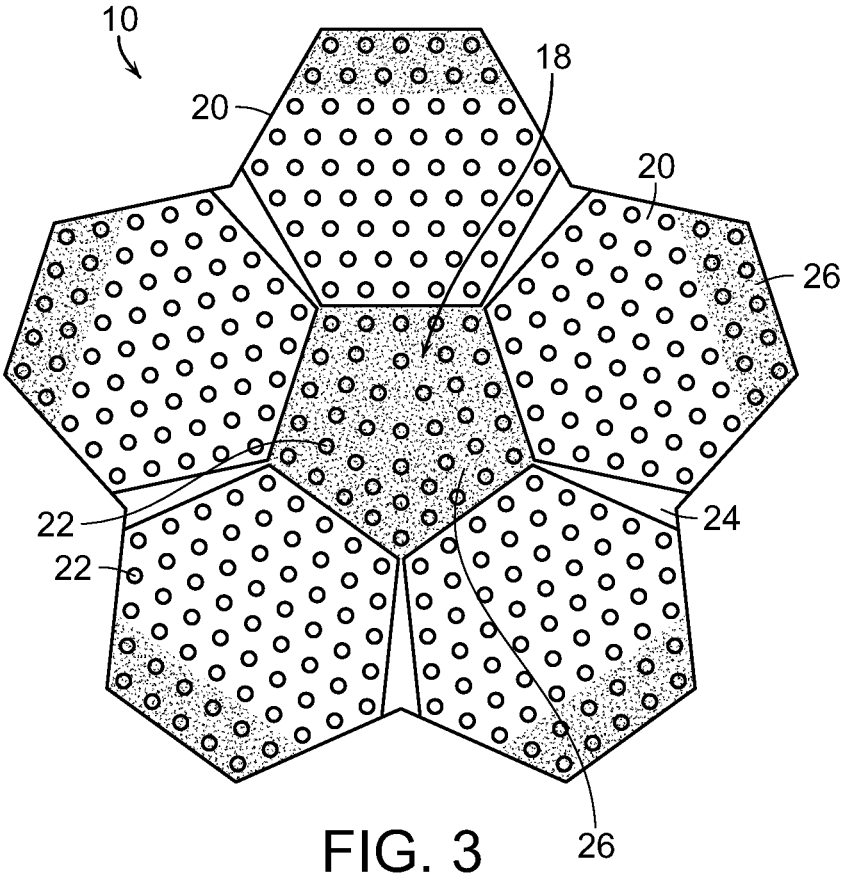
FIG. 3 is a top plan view of an alternate embodiment of the throw toy of FIG. 1.

With continuing reference to FIG. 3, the throw toy 10 may have portions or parts that are comprised of different materials. For example, portions of the throw toy 10 may be comprised of a phosphorescent material 26. As illustrated in FIG. 3, the central portion comprising the central hub 18 and the outer edges of the segments 20 defining the skirt may be comprised of a phosphorescent material 26. However, the phosphorescent material 26 is not limited to these positions but may comprise other parts of the throw toy 10 or even the entire throw toy 10. The phosphorescent material 26 may be a rubber or silicone or other elastomeric material that is easily folded into the shape of a ball, but may contain zinc sulfide, strontium aluminate, or other photoluminescent phosphor to allow the material to glow in the dark.

Figure 6:
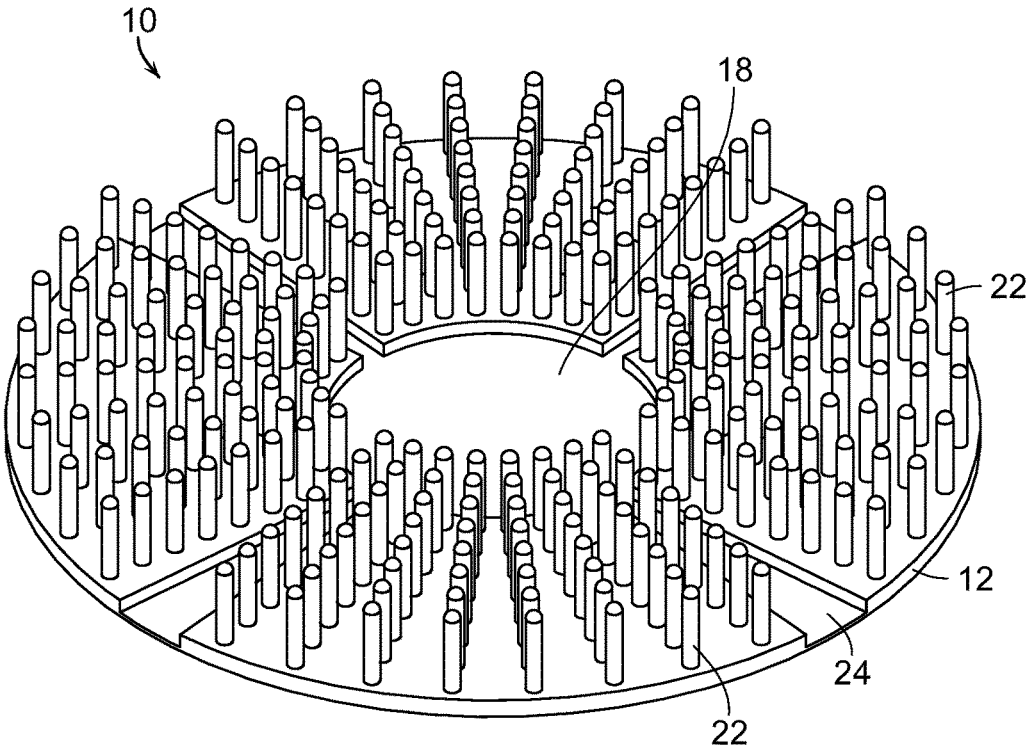
FIG. 6 is a top perspective view of an alternate embodiment of the throw toy in the shape of a circle.
Figure 7:
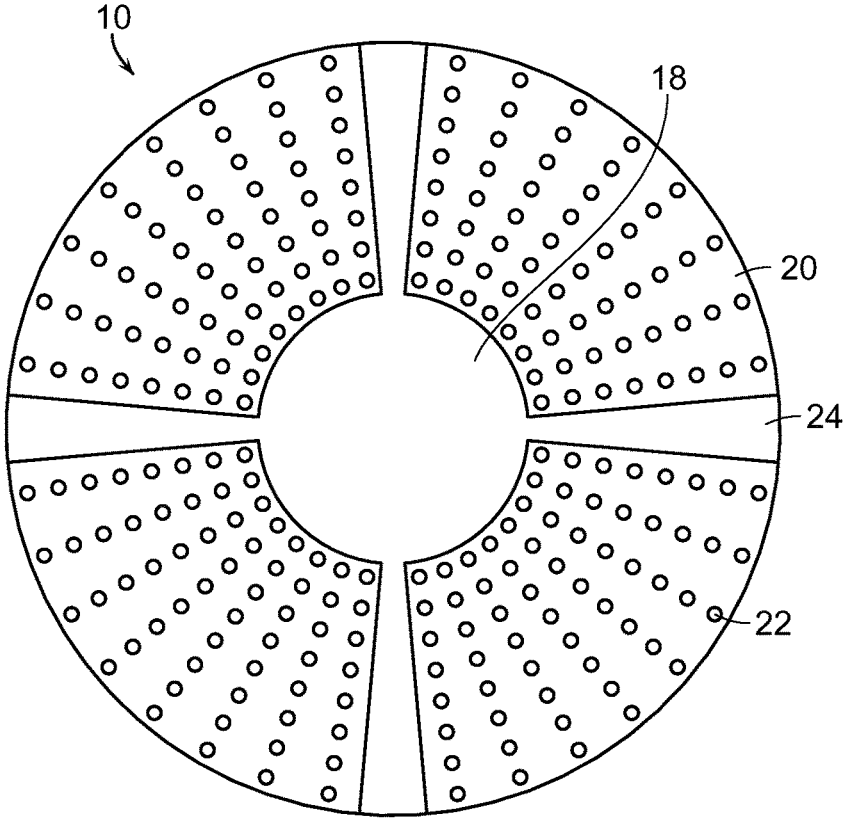
FIG. 7 is a top plan view of the throw toy of FIG. 3.

The throw toy 10 is not limited in shape but be made and work effectively in a variety of different shapes and sizes. For example, as illustrated in FIGS. 6 and 7, another embodiment of the throw toy 10 of the present invention is illustrated. While all of the illustrated embodiments herein have a base 12 which is generally disc-shaped, the throw toy 10 of FIGS. 6 and 7 is circular, and includes a circular central hub 18, although it is not limited to such.

Figure 9:
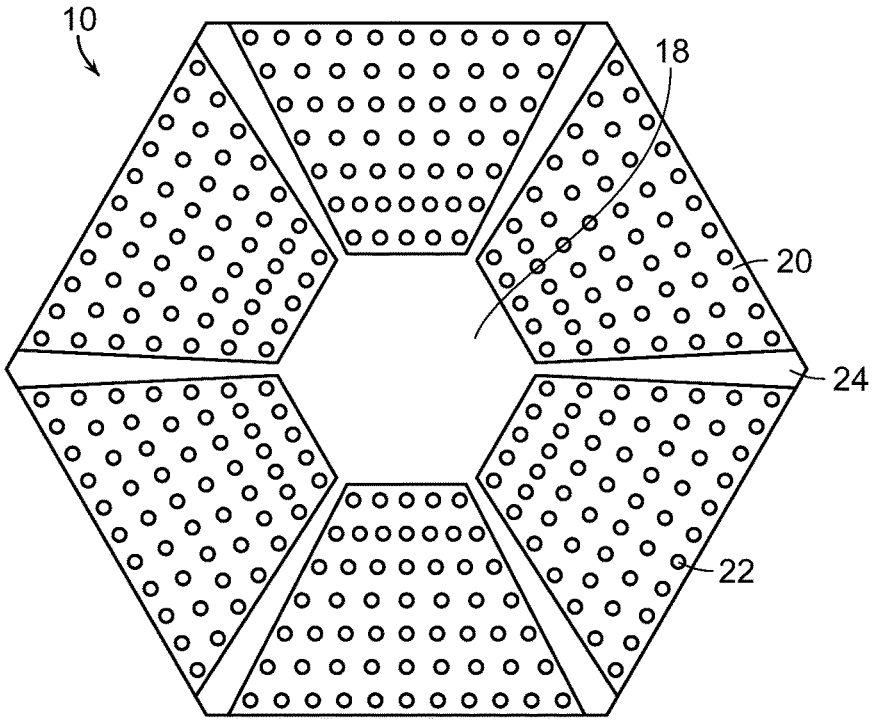
FIG. 9 is a top plan view of the throw toy of FIG. 5.

With reference to FIGS. 8 and 9, yet another configuration of the throw toy 10 is shown, wherein the central hub 18 is of a generally hexagonal shape, as is the skirt and overall configuration of the throw toy 10. However, the individual segments 20 comprising the skirt are of a general trapezoid shape. It will be appreciated that the geometric configuration of the central hub 18, segments 20 and overall shape of the skirt and throw toy 10 can be varied as desired so as to include rounded edges, straight edges, circular or semicircular configurations or multifaceted geometric objects.

Figure 10:
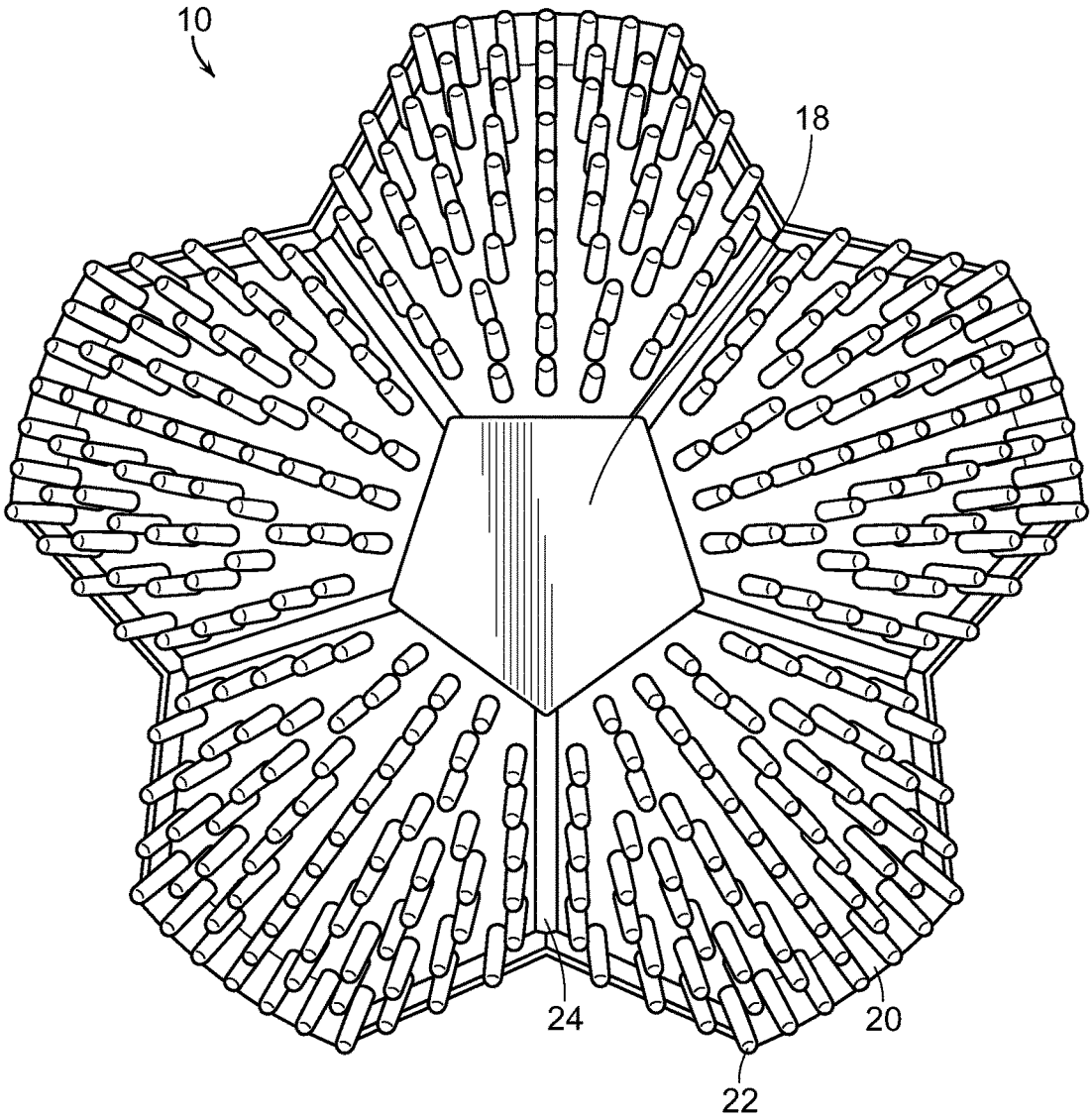
FIG. 10 is a top view of another throw toy embodying the present invention.
Figure 11:
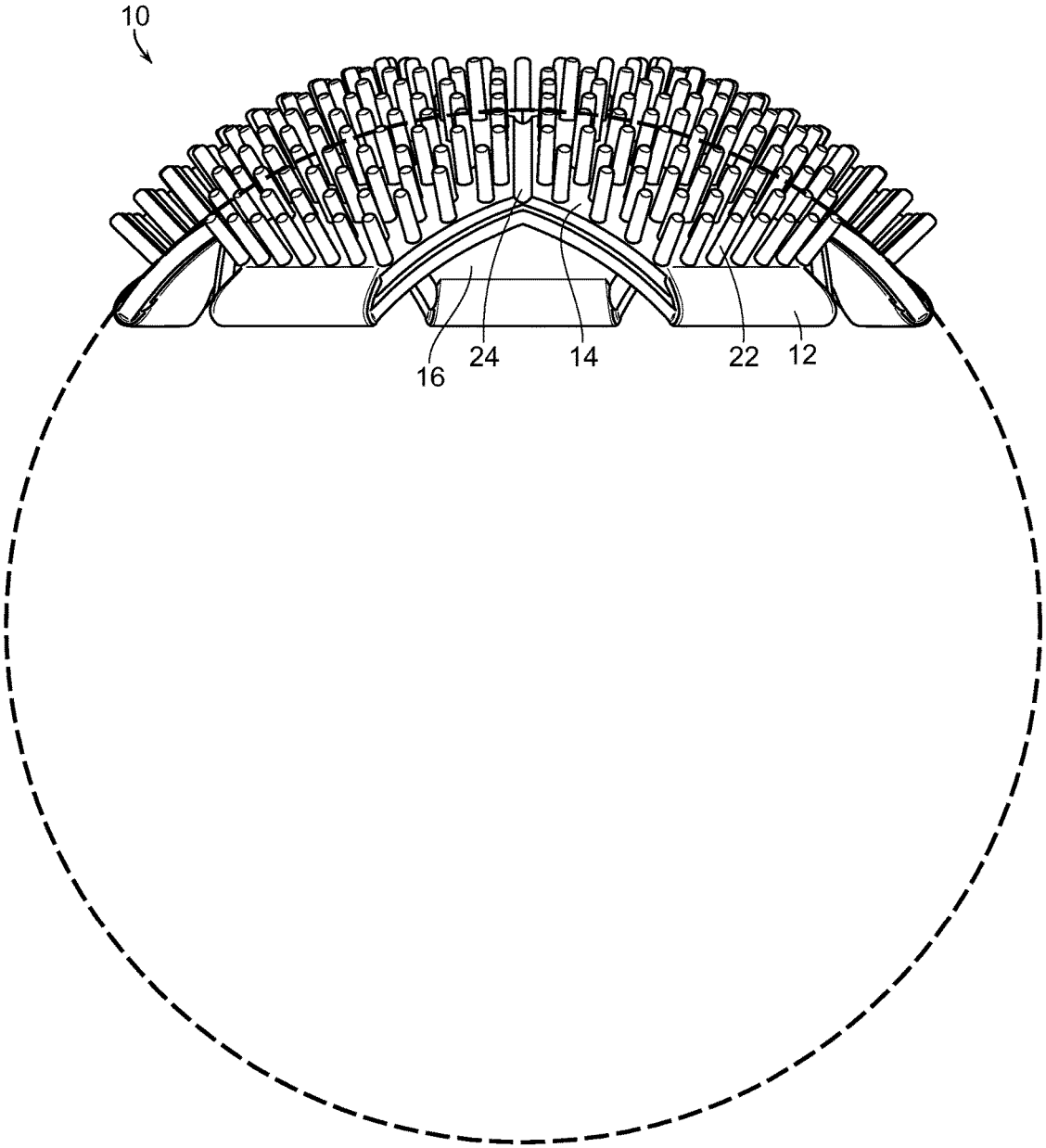
FIG. 11 is a diagrammatic and perspective side view of the throw toy of FIG. 10, illustrating its semi-spherical shape.
Figure 12:
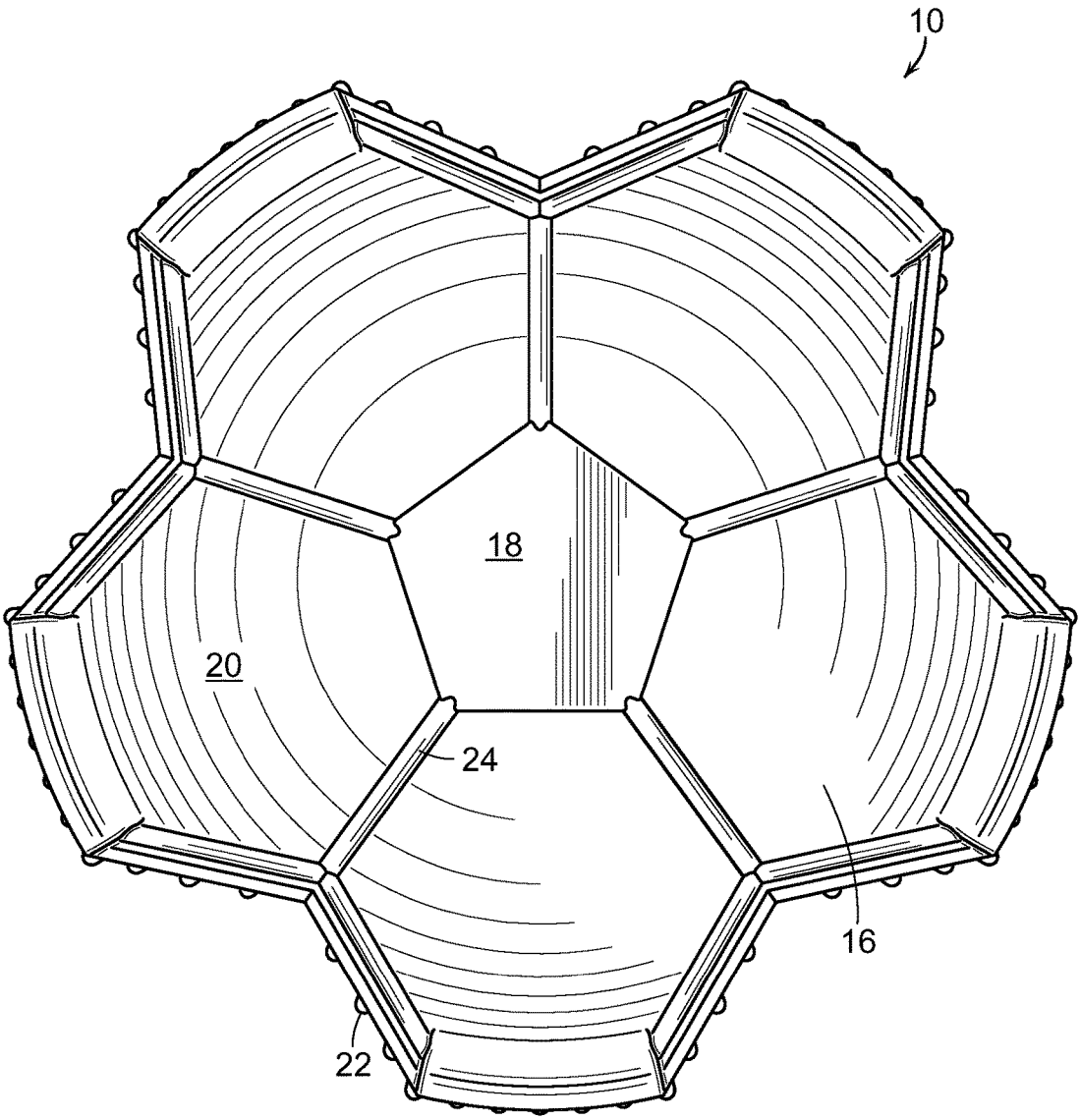
FIG. 12 is a bottom plan view of the throw toy of FIG. 10.

With reference now to FIGS. 10-12, yet another embodiment of the throw toy 10 of the present invention is illustrated. In this particular case, the central hub 18 is of a pentagon configuration, and the surrounding segments 20 forming the skirt are of a generally hexagonal configuration. In an embodiment of the invention, as illustrated in FIGS. 11 and 12, the second surface 16 of the base forms a concave semi-spherical surface when the throw toy 10 is stationary. However, although the base is biased to a semi-spherical shape when stationary, it flattens out in flight, as illustrated in FIG. 5.

Figure 13:
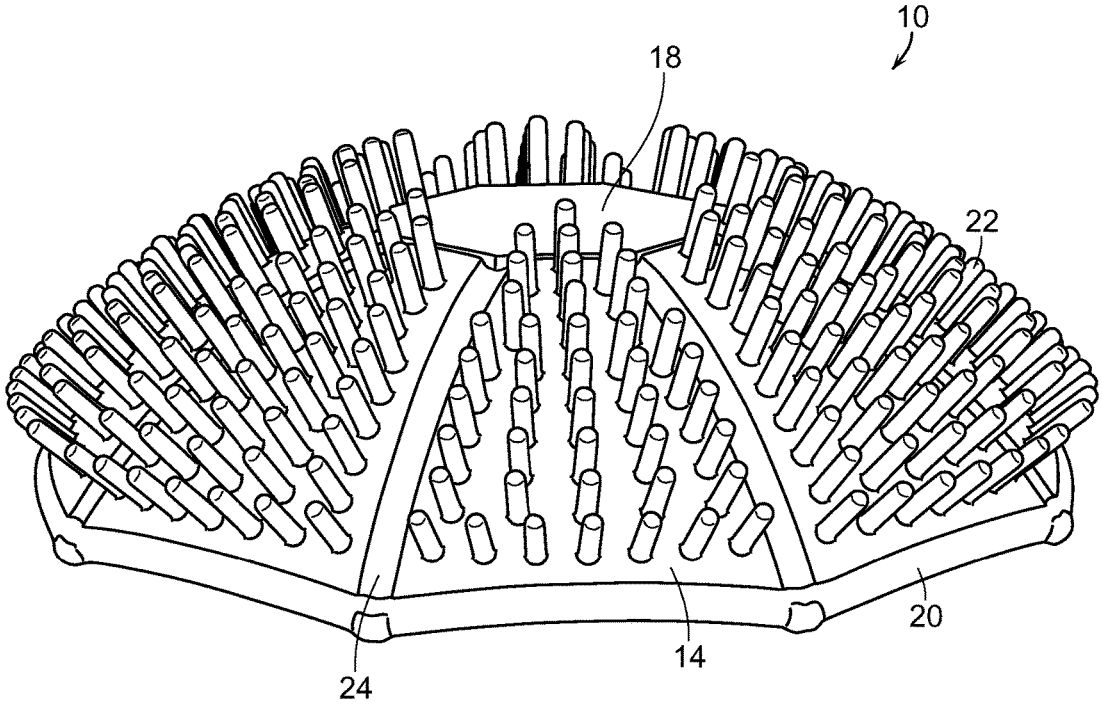
FIG. 13 is a side perspective view of another throw toy embodying the present invention.
Figure 14:
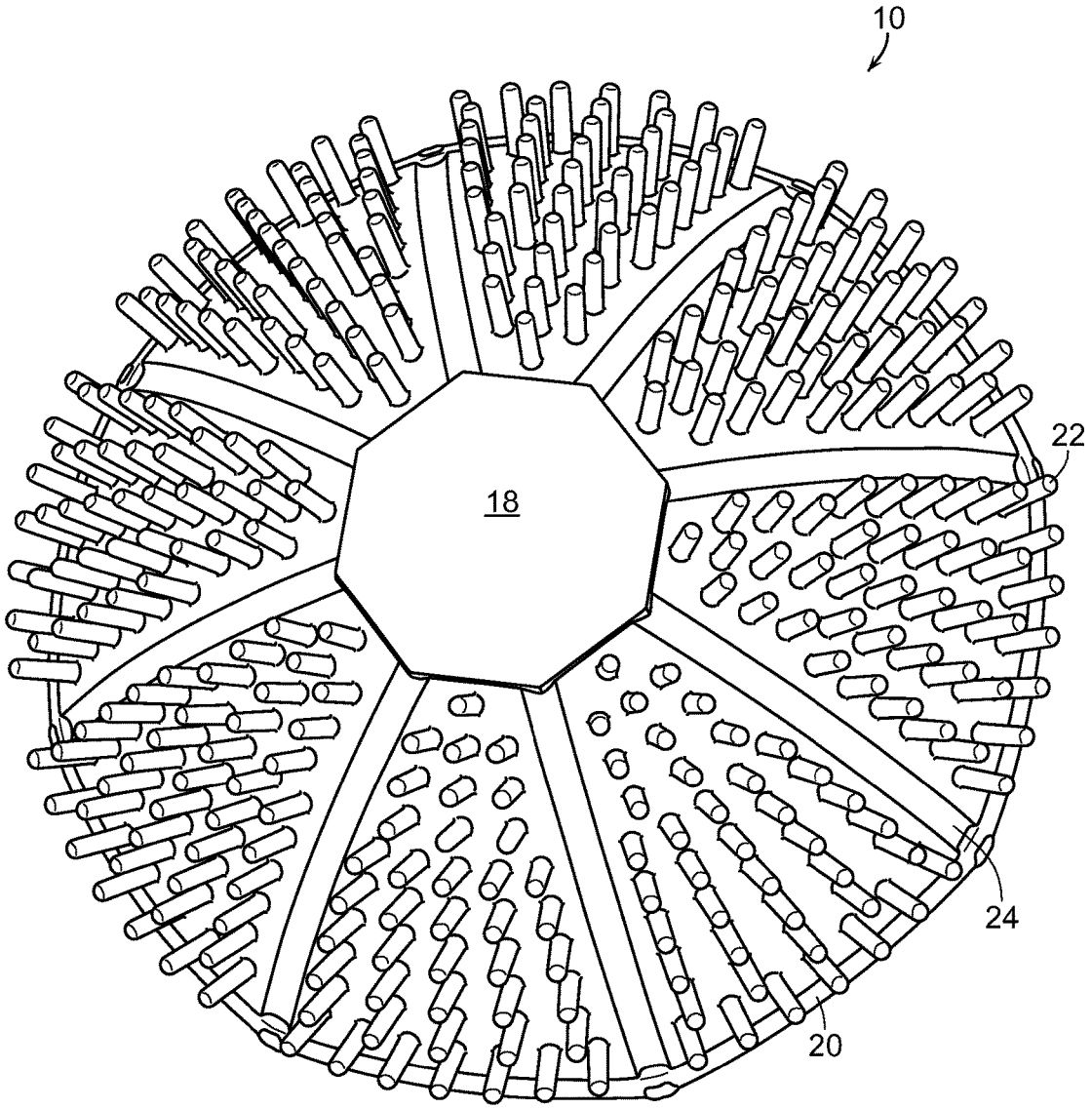
FIG. 14 is a top perspective view of the throw toy of FIG. 13.
Figure 15:
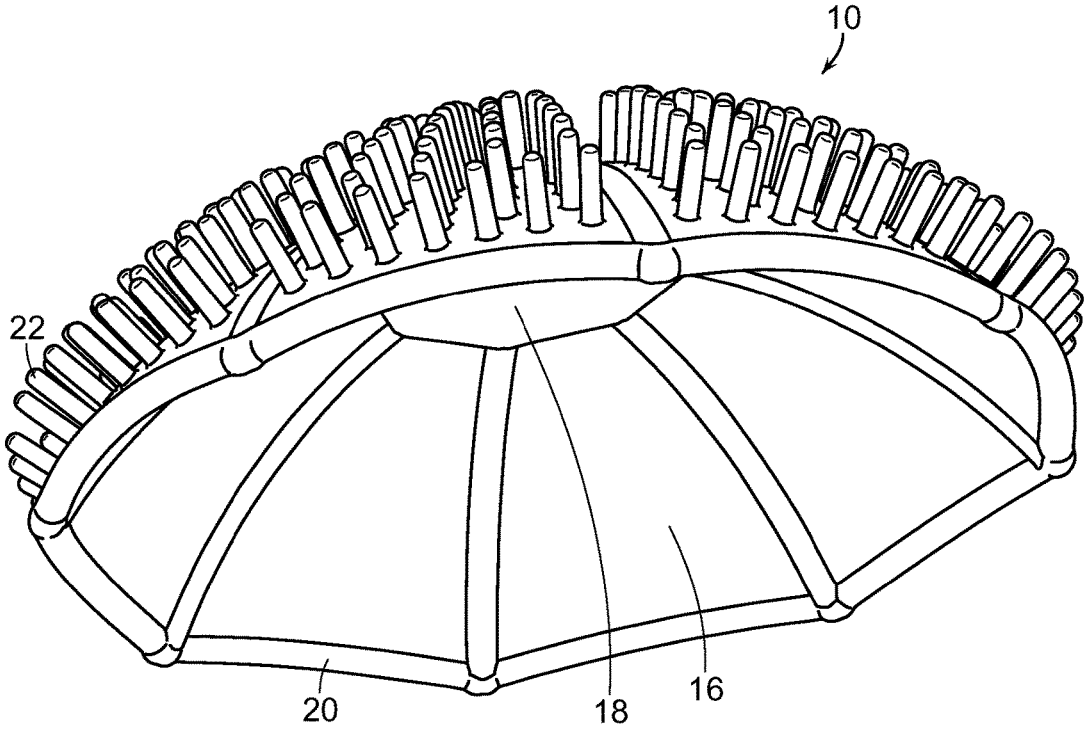
FIG. 15 is a lower perspective side view of the throw toy of FIG. 13.

With reference now to FIGS. 13-15, yet another throw toy 10 embodying the present invention is shown with a different configuration, wherein the central hub 18 is of a generally octagonal configuration and the segments 20 are of a generally truncated triangular or elongated trapezoidal configuration. The overall shape of the throw toy 10 is generally disc-shaped, however, and FIG. 15 illustrates that the base is biased to a semi-spherical shape when in the stationary and at-rest condition. The throw toy 10 embodied in FIGS. 13-15 also includes a central hub 18 having a thickness which is greater than that of the segments 20 forming the skirt of the throw toy 10.

Figure 16:
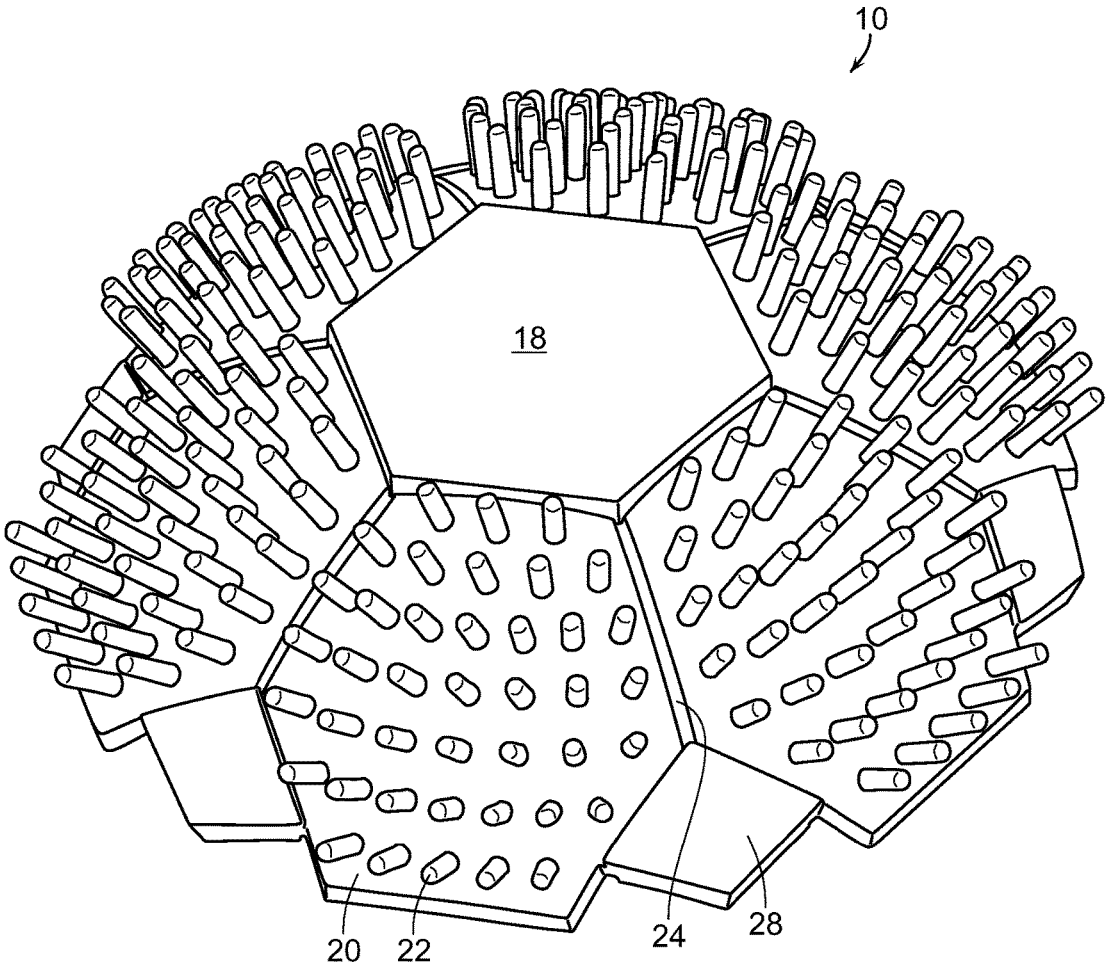
FIG. 16 is a perspective view of another throw toy embodying the present invention.
Figure 17:
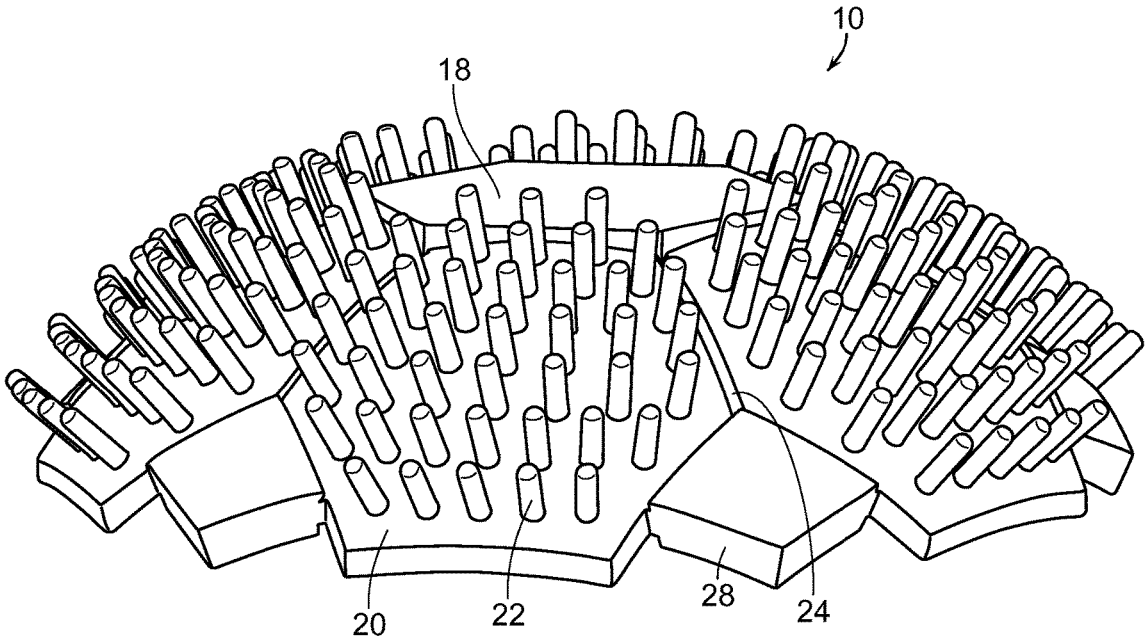
FIG. 17 is a side perspective view of the throw toy of FIG. 16.
Figure 18:
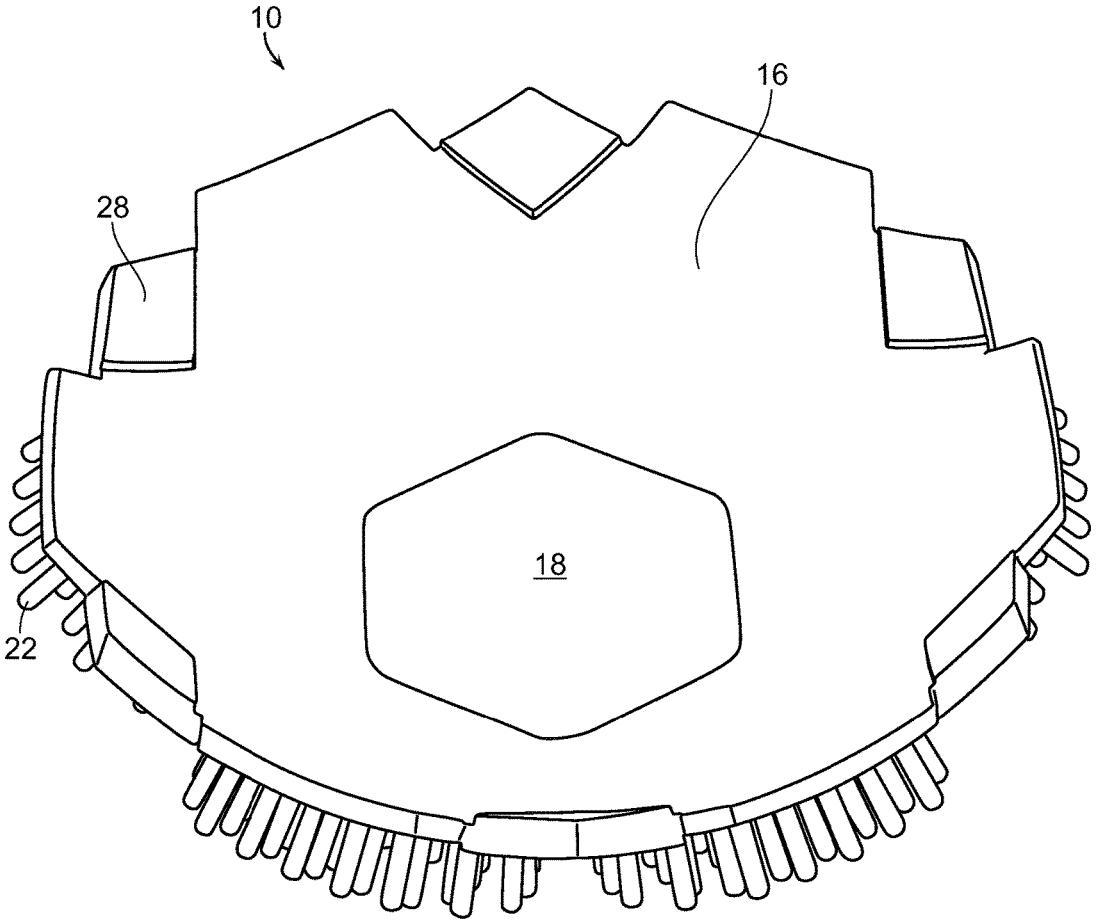
FIG. 18 is a bottom perspective view of the throw toy of FIGS. 16 and 17.

With reference now to FIGS. 16-18, yet another throw toy 10 embodying the present invention is shown. In this case, the central hub 18 is of a generally hexagonal configuration as are the segments 20 encircling it and forming the skirt. In this particular case, the central hub is of a greater thickness, such as being six millimeters in thickness as opposed to a three-millimeter thickness of the segments 20, for example. Secondary segments 28 may be provided to enhance the overall appearance of the throw toy 10. These also may be of a greater thickness than the segments 20, such as being five millimeters in thickness. Aside from providing a pleasing aesthetic look, the secondary segments 28 may also affect the flight of the throw toy 10, such as serving to flatten the throw toy 10 in flight, provide it stabilization, or provide it movement during flight such that the throw toy 10 undulates in the air while being thrown.

Although several embodiments have been described in detail for purposes of illustration, various modifications may be made without departing from the scope and spirit of the invention. Accordingly, the invention is not to be limited, except as by the appended claims.

What is claimed is:

1. A throw toy, comprising:

a generally disc-shaped elastomeric base having first and second surfaces, the base including:

a central hub;

a skirt encircling and extending outwardly from the central hub; and a plurality of projecting fingers extending away from the first surface of the base for stabilizing the throw toy in flight;

wherein the base is biased to a semi-spherical shape when stationary, but flattens in flight.

2. The throw toy of claim 1, wherein the second surface of the base forms a concave semi-spherical surface when the throw toy is stationary.

3. The throw toy of claim 1, wherein the second surface of the base is smooth and devoid of projecting fingers.

4. The throw toy of claim 1, wherein the base has sufficient flexibility to permit its being folded into a ball prior to being thrown, and once thrown assuming a generally planar configuration.

5. The throw toy of claim 1, wherein the base is comprised of a silicone or rubber material.

6. The throw toy of claim 1, wherein the projecting fingers are configured and arranged to cause lift to the throw toy by air passing through and/or over the projecting fingers.

7. The throw toy of claim 1, wherein the skirt is comprised of multiple segments extending from the central hub and disposed adjacent to one another.

8. The throw toy of claim 7, wherein the multiple segments have generally identical geometric configurations.

9. The throw toy of claim 7, including a hinge formed in the base between adjacent edges of the segments.

10. The throw toy of claim 9, wherein the hinges extend from the central hub between adjacent edges of the segments to a peripheral edge of the skirt.

11. The throw toy of claim 9, wherein the hinges are of a reduced thickness compared to the segments.

12. The throw toy of claim 7, wherein each segment includes a plurality of projecting fingers extending from the first surface thereof.

13. The throw toy of claim 12, wherein each segment includes approximately an equal number of projecting fingers.

14. The throw toy of claim 12, wherein the projecting fingers of a segment are substantially equally spaced apart from adjacent projecting fingers.

15. A throw toy, comprising:

a generally disc-shaped elastomeric base having first and second surfaces, the base including:

a central hub;

a skirt encircling and extending outwardly from the central hub, the skirt comprised of multiple segments of generally identical geometric configuration extending from the central hub and disposed adjacent to one another; and a plurality of projecting fingers extending away from the first surface of the base, the projecting fingers being configured and arranged to cause lift and stabilize the throw toy in flight;

wherein the second surface of the base is smooth and devoid of projecting fingers;

wherein the base has sufficient flexibility to permit its being folded into a ball prior to being thrown, and once thrown assuming a generally planar configuration;

wherein a hinge is formed in the base between adjacent edges of the segments.

16. The throw toy of claim 15, wherein the second surface of the base forms a concave semi-spherical surface when the throw toy is stationary, but flattens in flight.

17. The throw toy of claim 15, wherein the hinges extend from the central hub between adjacent edges of the segments to a peripheral edge of the skirt.

18. The throw toy of claim 15, wherein the hinges are of a reduced thickness compared to the segments.

19. The throw toy of claim 15, wherein each segment includes a plurality of projecting fingers extending from the first surface thereof.

20. The throw toy of claim 19, wherein each segment includes approximately an equal number of projecting fingers.

21. The throw toy of claim 19, wherein the projecting fingers of a segment are substantially equally spaced apart from adjacent projecting fingers.

22. A throw toy, comprising:

a generally disc-shaped elastomeric base having first and second surfaces, the base including:

a central hub;

a skirt encircling and extending outwardly from the central hub, the skirt comprised of multiple segments of generally identical geometric configuration extending from the central hub and disposed adjacent to one another;

a hinge formed in the base between adjacent edges of the segments having reduced thickness compared to the segments;

a plurality of projecting fingers extending away from the first surface of the base, the projecting fingers being configured and arranged to cause lift and stabilize the throw toy in flight;

wherein each segment includes a plurality of projecting fingers extending from the first surface thereof;

wherein the second surface of the base is smooth and devoid of projecting fingers; and wherein the base has sufficient flexibility to permit its being folded into a ball prior to being thrown, and once thrown assuming a generally planar configuration.

23. The throw toy of claim 22, wherein the second surface of the base forms a concave semi-spherical surface when the throw toy is stationary, but flattens in flight.

24. The throw toy of claim 22, wherein the hinges extend from the central hub between adjacent edges of the segments to a peripheral edge of the skirt.

25. The throw toy of claim 22, wherein each segment includes approximately an equal number of projecting fingers.

26. The throw toy of claim 22, wherein the projecting fingers of a segment are substantially equally spaced apart from adjacent projecting fingers.

27. A throw toy, comprising:

a generally disc-shaped elastomeric base having first and second surfaces, the base including:

a central hub;

a skirt encircling and extending outwardly from the central hub; and a plurality of projecting fingers extending away from the first surface of the base for stabilizing the throw toy in flight;

wherein the skirt is comprised of multiple segments extending from the central hub and disposed adjacent to one another; and wherein a hinge is formed in the base between adjacent edges of the segments.

28. The throw toy of claim 27, wherein the base is biased to a semi-spherical shape when stationary, but flattens in flight.

29. The throw toy of claim 28, wherein the second surface of the base forms a concave semi-spherical surface when the throw toy is stationary.

30. The throw toy of claim 27, wherein the second surface of the base is smooth and devoid of projecting fingers.

31. The throw toy of claim 27, wherein the base has sufficient flexibility to permit its being folded into a ball prior to being thrown, and once thrown assuming a generally planar configuration.

32. The throw toy of claim 27, wherein the base is comprised of a silicone or rubber material.

33. The throw toy of claim 27, wherein the projecting fingers are configured and arranged to cause lift to the throw toy by air passing through and/or over the projecting fingers.

34. The throw toy of claim 27, wherein the multiple segments have generally identical geometric configurations.

35. The throw toy of claim 27, wherein the hinges extend from the central hub between adjacent edges of the segments to a peripheral edge of the skirt.

36. The throw toy of claim 27, wherein the hinges are of a reduced thickness compared to the segments.

37. The throw toy of claim 27, wherein each segment includes a plurality of projecting fingers extending from the first surface thereof.

38. The throw toy of claim 37, wherein each segment includes approximately an equal number of projecting fingers.

39. The throw toy of claim 37, wherein the projecting fingers of a segment are substantially equally spaced apart from adjacent projecting fingers.

* * * * *